US009519239B2

(12) United States Patent
Wada et al.

(10) Patent No.: US 9,519,239 B2
(45) Date of Patent: Dec. 13, 2016

(54) IMAGE FORMING APPARATUS THAT CALCULATES TONER CONCENTRATION IN DEVELOPER

(71) Applicant: Kyocera Document Solutions Inc., Osaka (JP)

(72) Inventors: Minoru Wada, Osaka (JP); Ryo Taniguchi, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 6 days.

(21) Appl. No.: 14/716,821

(22) Filed: May 19, 2015

(65) Prior Publication Data

US 2015/0331355 A1 Nov. 19, 2015

(30) Foreign Application Priority Data

May 19, 2014 (JP) ..... 2014-103641

(51) Int. Cl.
*G03G 15/08* (2006.01)

(52) U.S. Cl.
CPC ..... *G03G 15/08* (2013.01); *G03G 15/0824* (2013.01)

(58) Field of Classification Search
CPC ..... G03G 15/00; G03G 15/06; G03G 15/08; G03G 15/0822; G03G 15/0824; G03G 15/0849; G03G 15/00054; G03G 15/5041; G03G 15/5058
USPC ..... 399/30, 58–62, 64, 72, 74
See application file for complete search history.

(56) References Cited

FOREIGN PATENT DOCUMENTS

JP H10-232523 A 9/1998

*Primary Examiner* — Walter L Lindsay, Jr.
*Assistant Examiner* — Ruth Labombard
(74) *Attorney, Agent, or Firm* — James Judge

(57) ABSTRACT

An image forming apparatus includes an image carrier, a developing roller, and a control unit. The image carrier has a surface on which an electrostatic latent image is formed. The developing roller is arranged to face the image carrier to form a development nip between the image carrier and the developing roller. The developing roller supplies toner in a two-component developer carried on a surface of the developing roller to the image carrier in the development nip so as to develop the electrostatic latent image. The control unit drivingly controls the image carrier and the developing roller. The control unit discharges the toner in the development nip to the image carrier in a state where the developing roller is stopped, so as to calculate a toner concentration in the two-component developer based on an amount of discharged toner.

5 Claims, 6 Drawing Sheets

IMAGE FORMING APPARATUS THAT CALCULATES TONER CONCENTRATION IN DEVELOPER

INCORPORATION BY REFERENCE

This application is based upon, and claims the benefit of priority from, corresponding Japanese Patent Application No. 2014-103641 filed in the Japan Patent Office on May 19, 2014, the entire contents of which are incorporated herein by reference.

BACKGROUND

Unless otherwise indicated herein, the description in this section is not prior art to the claims in this application and is not admitted to be prior art by inclusion in this section.

Regarding an image forming apparatus for low-speed region, the price in the market has been slashed, and the apparatus has been downsized and lightweight. Also, a low-cost developing device is preferred. Accordingly, there is a technology that performs image density control on a developing device that employs a two-component developer without using a toner concentration sensor, which detects toner concentration (what is called T/C) in the developer. For example, there is a technology that forms a long band patch extending in the axial direction of a photoreceptor drum, calculates the correction value of the toner supply amount based on the image density of the band patch, and detects an accurate toner supply amount using this correction value.

SUMMARY

An image forming apparatus according to one aspect of the disclosure includes an image carrier, a developing roller, and a control unit. The image carrier has a surface on which an electrostatic latent image is formed. The developing roller is arranged to face the image carrier to form a development nip between the image carrier and the developing roller. The developing roller supplies toner in a two-component developer carried on a surface of the developing roller to the image carrier in the development nip so as to develop the electrostatic latent image. The control unit drivingly controls the image carrier and the developing roller. The control unit discharges the toner in the development nip to the image carrier in a state where the developing roller is stopped, so as to calculate a toner concentration in the two-component developer based on an amount of discharged toner.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

DETAILED DESCRIPTION

Figure 1:
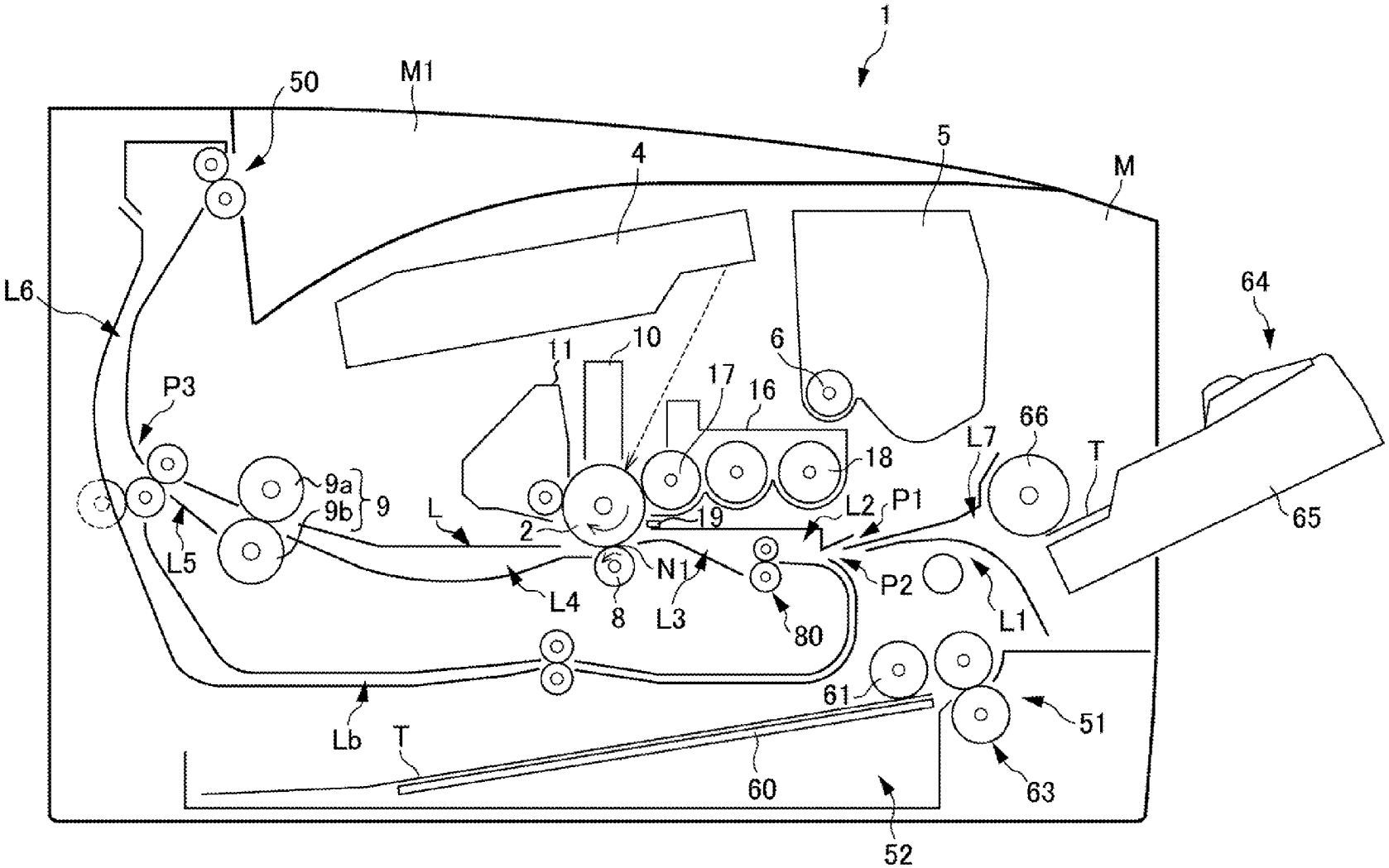
FIG. 1 illustrates a cross section of configuration of an image forming apparatus according to one embodiment of the disclosure from the left side.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

The following describes image forming apparatus according to one embodiment of the disclosure with reference to the drawings. FIG. 1 illustrates a cross section of configuration of an image forming apparatus according to one embodiment of the disclosure from the left side.

An image forming apparatus 1 according to one embodiment of the disclosure is, for example, a printer. In this embodiment, a side (right side in FIG. 1) where a bypass tray 65, which is described below, is arranged denotes the front side of the image forming apparatus 1.

The image forming apparatus 1 has a housing M, an image forming unit, and a paper sheet feeding and discharging unit. The image forming unit forms a predetermined image on a paper sheet (transferred material) T based on predetermined image information. The paper sheet feeding and discharging unit feeds a paper sheet T to the image forming unit, and discharges the paper sheet T on which an image has been formed.

As illustrated in FIG. 1, the image forming unit includes a photoreceptor drum 2, a charging unit 10, a laser scanner unit 4, a developing device 16, a toner cartridge 5, a toner feeder 6, a transfer roller 8, a fixing unit 9, and a drum cleaning unit 11. Additionally, the paper sheet feeding and discharging unit includes a sheet feed cassette 52, the bypass tray 65, a registration roller pair 80, and a conveyance path L of paper sheet T.

The photoreceptor drum 2 is made of a cylindrical shaped member to function as an image carrier. The photoreceptor drum 2 is arranged in the housing M in a state where the photoreceptor drum 2 is rotatable about a rotation shaft perpendicular to FIG. 1. On the surface of the photoreceptor drum 2, an electrostatic latent image is formed.

The charging unit 10 is arranged above the photoreceptor drum 2. The charging unit 10 uniformly and positively (positive polarity) charges the surface of photoreceptor drum 2.

The laser scanner unit 4 is arranged above photoreceptor drum 2 and separated from the photoreceptor drum 2. The laser scanner unit 4 includes a laser light source (not illustrated), a polygon mirror (not illustrated), and a polygon mirror drive motor (not illustrated) and similar unit.

The laser scanner unit 4 scans and exposes the surface of the photoreceptor drum 2 based on image information output from an external device such as a personal computer (PC). Scan and exposure by the laser scanner unit 4 causes removal of the electric charge charged on the surface of the photoreceptor drum 2. Thus, an electrostatic latent image is formed on the surface of photoreceptor drum 2.

The developing device 16 is arranged ahead of the photoreceptor drum 2 (right side in FIG. 1). The developing device 16 develops a single color (usually black) toner image on the electrostatic latent image formed on the photoreceptor drum 2. The developing device 16 includes a developing roller 17 configured to be arranged to face the photoreceptor drum 2, and a stirring spiral 18 for stirring a developer. The embodiment employs the two-component developer.

An image density sensor 19 is arranged further ahead of the photoreceptor drum 2. The image density sensor 19 detects print density of a toner image on the surface of the photoreceptor drum 2, which is developed by the developing roller 17. Specifically, the image density sensor 19 includes a light sensor that has a light-emitting portion (not illustrated), which emits light onto the surface of the photoreceptor drum 2, and a light-receiving portion (not illustrated), which receives the light reflected on the surface of the photoreceptor drum 2. The image density sensor 19 detects this print density of a toner image using the reflected light of the toner image formed on the surface of the photoreceptor drum 2.

The toner cartridge 5 houses a toner to be supplied to the developing device 16.

The toner feeder 6 supplies the toner housed in the toner cartridge 5 to the developing device 16.

The drum cleaning unit 11 is arranged behind (left side in FIG. 1) the photoreceptor drum 2. The drum cleaning unit 11 removes remnant developer and adhered matter on the surface of the photoreceptor drum 2, conveys the removed developer and similar matter to the predetermined recovery mechanism, and then cause the recovery mechanism to recover the removed developer and similar matter.

The transfer roller 8 functions as a transfer apparatus that transfers the toner image developed on the surface of the photoreceptor drum 2 to a paper sheet T. A transfer bias is applied to the transfer roller 8 to transfer the toner image on the surface of the photoreceptor drum 2 to the paper sheet T by a voltage applying unit (not illustrated).

The transfer roller 8 contacts and separates from the photoreceptor drum 2. Specifically, the transfer roller 8 is configured to move to an abutting position, where the photoreceptor drum 2 abuts on the transfer roller 8, and a separation position, where the photoreceptor drum 2 separates from the transfer roller 8. In detail, for transferring the toner image developed on the photoreceptor drum 2 to the paper sheet T, the transfer roller 8 moves to the abutting position. Otherwise, the transfer roller 8 moves to the separation position.

The paper sheet T is sandwiched between the photoreceptor drum 2 and the transfer roller 8, and then is pressed against the surface of the photoreceptor drum 2 (side where the toner image is developed). Thus, a transfer nip N1 is formed. At the transfer nip N1, the toner image on the surface of the photoreceptor drum 2 is transferred to the paper sheet T.

The fixing unit 9 melts the toner constituting the toner image transferred to the paper sheet T, and then fixes the toner onto the paper sheet T. The fixing unit 9 includes a heating roller 9*a* and a pressure roller 9*b* which is brought into pressure contact with the heating roller 9*a*. The heating roller 9*a* and the pressure roller 9*b* convey the paper sheet T on which the toner image is transferred while sandwiching the paper sheet T. Conveying the paper sheet T sandwiched between the heating roller 9*a* and the pressure roller 9*b* causes melting and fixing of the toner transferred onto the paper sheet T.

The sheet feed cassette 52 is arranged at the lower side of the housing M. The sheet feed cassette 52 is arranged in the front side (right side in FIG. 1) of the housing M, and can be drawn in horizontal direction. The sheet feed cassette 52 includes a platen 60 on which the paper sheet T is to be placed. In the sheet feed cassette 52, in a state where the paper sheets T are stacked on the platen 60, the paper sheets T are housed. A cassette paper sheet feeder 51 is arranged at a side end portion where the sheet feed cassette 52 conveys a paper sheet (right-side end portion in FIG. 1). The cassette paper sheet feeder 51 conveys the paper sheets T housed in the sheet feed cassette 52 to a conveyance path L.

The cassette paper sheet feeder 51 includes a multi feeding prevention mechanism. The multi feeding prevention mechanism includes a forward transfer roller 61, which takes out a paper sheet T placed on the platen 60, and a roller pair 63, which feeds the paper sheets T one by one to the conveyance path L.

Between the cassette paper sheet feeder 51 or a manual paper feed tray 64 and a paper sheet discharge unit 50, the conveyance path L, which conveys the paper sheet T, is formed. The conveyance path L has a first conveyance path L1, a second conveyance path L2, a third conveyance path L3, a fourth conveyance path L4, a fifth conveyance path L5, a sixth conveyance path L6, and a seventh conveyance path L7. The first conveyance path L1 is a conveyance path from the cassette paper sheet feeder 51 to a first merging portion P1. The second conveyance path L2 is a conveyance path from the first merging portion P1 to the registration roller pair 80. The third conveyance path L3 is a conveyance path from the registration roller pair 80 to the transfer roller 8. The fourth conveyance path L4 is a conveyance path from the transfer roller 8 to the fixing unit 9. The fifth conveyance path L5 is a conveyance path from the fixing unit 9 to a branching portion P3. The sixth conveyance path L6 is a conveyance path from the branching portion P3 to the paper sheet discharge unit 50. The seventh conveyance path L7 is a conveyance path from the bypass tray 65 to the first merging portion P1.

The first merging portion P1 is a merging portion of the first conveyance path L1 and the seventh conveyance path L7. The first conveyance path L1 is a path where the paper sheet T is conveyed from the cassette paper sheet feeder 51. The seventh conveyance path L7 is a path where the paper sheet T is conveyed from the bypass tray 65.

In the middle of the second conveyance path L2, a second merging portion P2 is arranged. Furthermore, the conveyance path L has a return conveyance path Lb from the branching portion P3 to the second merging portion P2. The second merging portion P2 is a merging portion of the second conveyance path L2 and the return conveyance path Lb.

With respect to the transfer roller 8, at the upstream side (right side in FIG. 1) of the conveyance direction of the paper sheet T, the registration roller pair 80 is arranged.

The return conveyance path Lb is a conveyance path located to face the opposite surface (non-print job surface)

from the printed job surface to the photoreceptor drum 2 when performing duplex printing on a paper sheet T.

In the front surface (right side in FIG. 1) of the housing M and above the sheet feed cassette 52, the manual paper feed tray 64 is located. The manual paper feed tray 64 includes the bypass tray 65, which is a paper sheet placing unit, and a paper feeding roller 66, which is a feed roller.

A paper discharge stacker M1 is formed at the opening side of the paper sheet discharge unit 50. The paper discharge stacker M1 is formed on the top surface (outer surface) of the housing M. The paper discharge stacker M1 is a part where the top surface of the housing M is depressed downward and then formed. The bottom surface of the paper discharge stacker M1 constitutes a part of the top surface of the housing M. In the paper discharge stacker M1, the paper sheets T that are discharged from the paper sheet discharge unit 50 and predetermined images are transferred on are stacked and aggregated.

Figure 2:
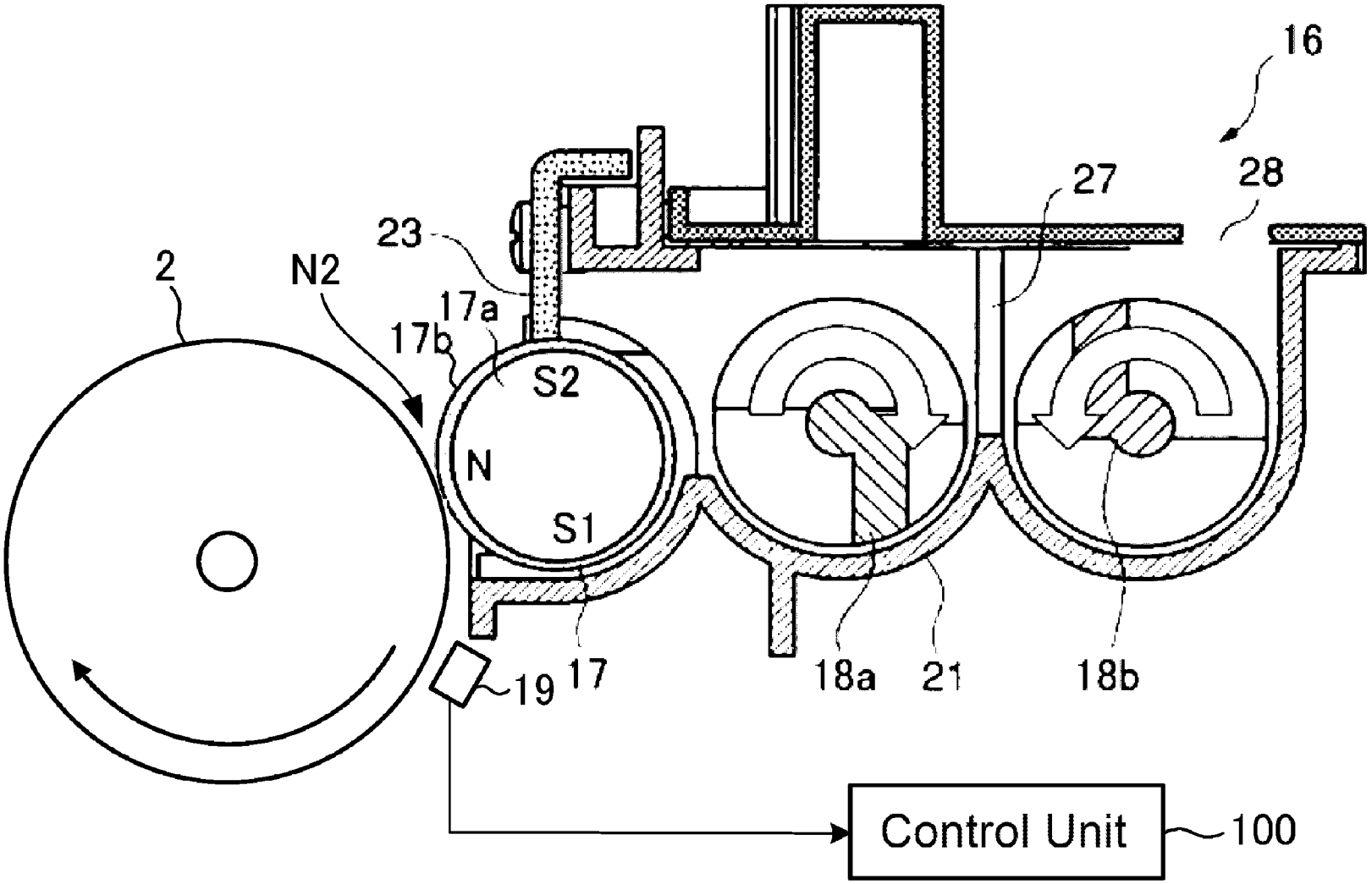
FIG. 2 schematically illustrates components related to development process of the image forming apparatus according to the one embodiment.

Next, the following describes a development process of the image forming apparatus 1. FIG. 2 schematically illustrates components related to the development process of the image forming apparatus 1. Furthermore, FIG. 2 illustrates the developing device 16 and the photoreceptor drum 2 in a cross-sectional view.

The developing device 16 has a developing container 21 that houses the two-component developer in which the toner and the magnetic carrier are mixed. In the developing container 21, the developing roller 17 is arranged to face the photoreceptor drum 2. At the facing position of the developing roller 17 and the photoreceptor drum 2, a development nip N2 is formed.

The developing roller 17 has a fixed magnet roller 17*a* and a development sleeve 17*b*. The fixed magnet roller 17*a* has a plurality of magnetic poles (for example, N, S1, and S2). The development sleeve 17*b* internally includes the fixed magnet roller 17*a*. The development sleeve 17*b*, for example, is made of a non-magnetic material such as an aluminum or stainless steel. The development sleeve 17*b* is driven and rotated anticlockwise in FIG. 2.

In the developing container 21, a blade 23 is arranged on the development sleeve 17*b* at the upstream side with respect to the development nip N2 along the rotation direction of the development sleeve 17*b*. The blade 23 regulates the amount of the passing developer attached on the surface of the development sleeve 17*b* to form a thin layer of the developer on the development sleeve 17*b*. In the developing container 21, a pair of stirring spirals 18*a* and 18*b* are arranged. The rotation shafts of the pair of the stirring spirals 18*a* and 18*b* are arranged horizontally to or above the rotation shaft of the developing roller 17. Between the pair of the stirring spiral 18*a* and the stirring spiral 18*b*, a partition wall 27 is arranged. The partition wall 27 extends in the longitudinal direction of the developing roller 17. At both ends of the partition wall 27 in longitudinal direction, a passage for passing the developer is defined. The rotary drive of the stirring spirals 18*a* and 18*b* cause a stir of the developer in the developing container 21 and a conveyance toward the direction of developing roller 17.

The toner passing through a toner replenishment port 28 from the toner cartridge 5 (see FIG. 1) and replenished to the developing container 21 is mixed with the carrier in the developing container 21. A rotary drive of the stirring spiral 18*b* stirs the toner and the carrier. The stirring spiral 18*b* conveys the developer made of these mixed toner and carrier to the stirring spiral 18*a* side, and the developer passes through the passage described above. Then, the stirring spiral 18*a* supplies the developing roller 17 with the developer. As illustrated by an outline arrow in FIG. 2, having the partition wall 27 as a border, the developer is conveyed to the stirring spiral 18*b*, the passage, the stirring spiral 18*a*, and the developing roller 17 in this order, and supplied to the development sleeve 17*b*. After that, the remnant developer in the development sleeve 17*b* is separated and recovered from the development sleeve 17*b*, and circulates again through the stirring spiral 18*b*, the passage, the stirring spiral 18*a*, and the developing roller 17.

As described above, when the developer is supplied to the circumference surface of the development sleeve 17*b*, the magnetic force of the fixed magnet roller 17*a* causes the developer to attach to the circumference surface of the development sleeve 17*b*. With the rotation of the development sleeve 17*b*, when the attached developer on the circumference surface of the development sleeve 17*b* passes the gap between the development sleeve 17*b* and the blade 23, the passing is regulated, and the thin layer of the developer is formed on the circumference surface of the development sleeve 17*b*.

The thin layer of the developer moves corresponding to the rotation of the development sleeve 17*b*. At the development nip N2, which is the closest position between the photoreceptor drum 2 and the developing roller 17, in a state where the developer on the development sleeve 17*b* contacts the surface of the photoreceptor drum 2, the alternating-current field applied between the photoreceptor drum 2 and the developing roller 17 causes the toner contained in this developer to move to the electrostatic latent image on the surface of the photoreceptor drum 2. Thus, the electrostatic latent image is developed, and the toner image is formed on the surface of the photoreceptor drum 2. At the development nip N2, the remnant toner and carrier on the development sleeve 17*b* that has not moved onto the photoreceptor drum 2 moves along with the rotation of the development sleeve 17*b*, and peeled off from the development sleeve 17*b* by the rotating action of the stirring spiral 18*a*. Then, a new developer is supplied to the development sleeve 17*b* by the stirring spiral 18*a*. As described above, the developer made of the toner and the carrier that are peeled off from the development sleeve 17*b* is mixed with the additionally replenished toner from the toner cartridge 5 while being circulated by the pair of the stirring spirals 18*a* and 18*b*.

A control unit 100 is one of the components of a control unit (not illustrated). This control unit is constituted of a Central Processing Unit (CPU), a RAM, a ROM, a dedicated hardware circuit and similar device, and manages an entire operation control of the image forming apparatus 1 by execution of a program read from a non-temporary recording medium. The control unit 100 controls the drive of the developing roller 17 and similar unit at the photoreceptor drum 2 and the developing device 16.

In particular, the image forming apparatus 1 according to the embodiment does not include a toner concentration sensor such as a magnetic permeability sensor to detect the toner concentration (T/C) of the two-component developer in the developing device 16. However, in the image forming apparatus 1 according to the embodiment, the control unit 100 ensures calculating the toner concentration in the two-component developer based on the amount of this discharged toner by discharging the toner in the development nip N2 to the photoreceptor drum 2 with the developing roller 17 stopped.

Specifically, the control unit 100 drives only the photoreceptor drum 2 in a state where the developing roller 17 is stopped, the electrostatic latent image is developed on the surface of the photoreceptor drum 2 by the toner contained in the developer in the development nip N2. At this time, in a state where a surface potential is not applied to the photoreceptor drum 2, a developing bias is applied to the photoreceptor drum 2 at a low surface potential (which is referred to as a bias development method), or a surface potential is applied to the photoreceptor drum 2, similarly to an ordinary development, an exposure forms a long patch in the rotation direction of the photoreceptor drum 2. Then, the developing bias is applied to perform the development.

Figure 3:
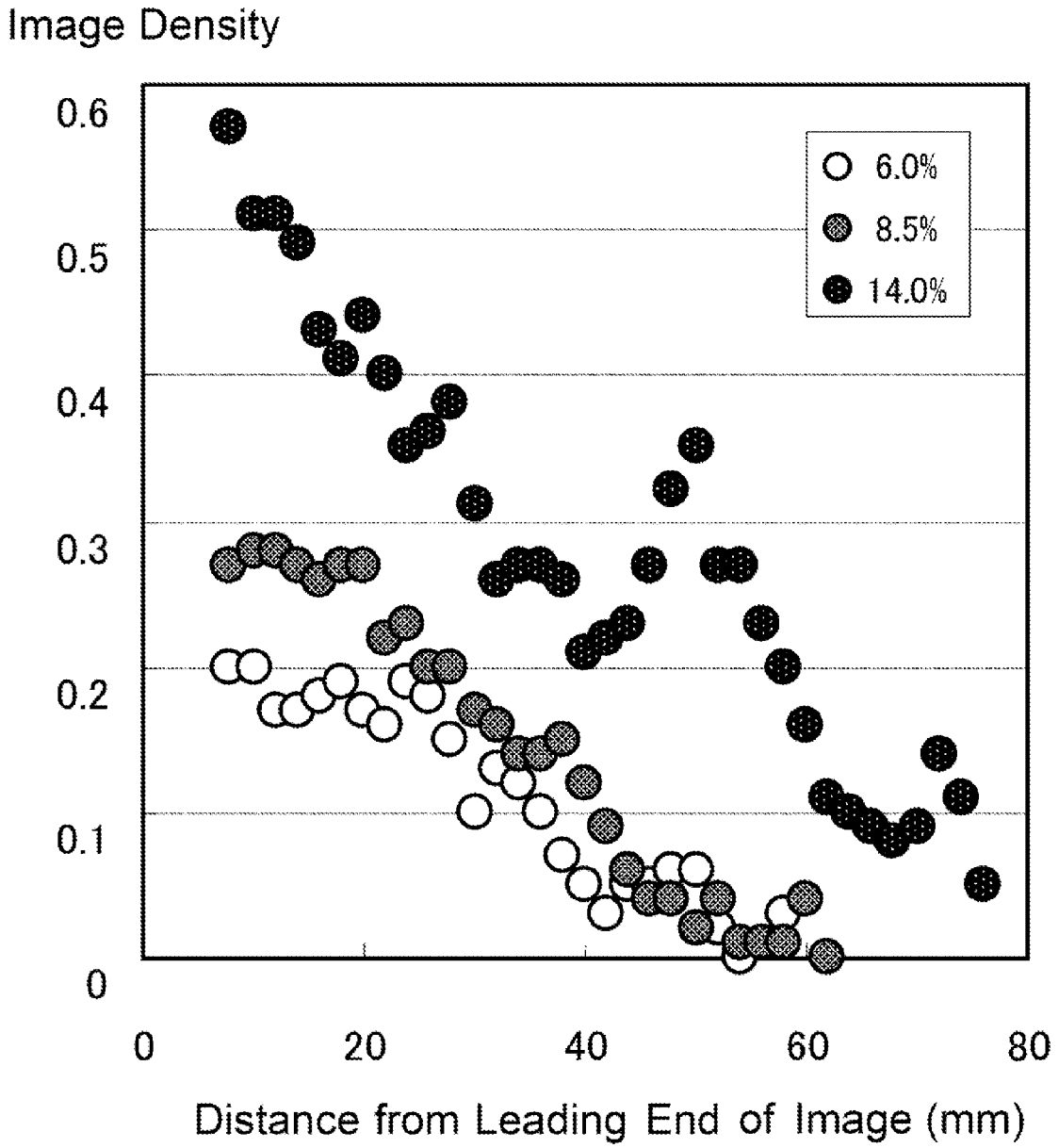
FIG. 3 illustrates a relationship between a distance from the head of a toner image and image density when a toner in a development nip according to the one embodiment is discharged and then developed.

FIG. 3 is a graph illustrating a relationship between a distance from the head of the toner image and image density when the toner in the development nip N2 is discharged and developed. The image density is calculated based on a detection signal of the image density sensor 19 in percentage. This graph plots three cases that toner concentrations are 6.0%, 8.5%, and 14.0%. In any development method described above, regardless of whether toner concentration is high or low, the image density of the toner image developed with the discharged toner in the development nip N2 is high at the head portion of the image, and has a tendency to decrease gradually toward the end.

Figure 4:
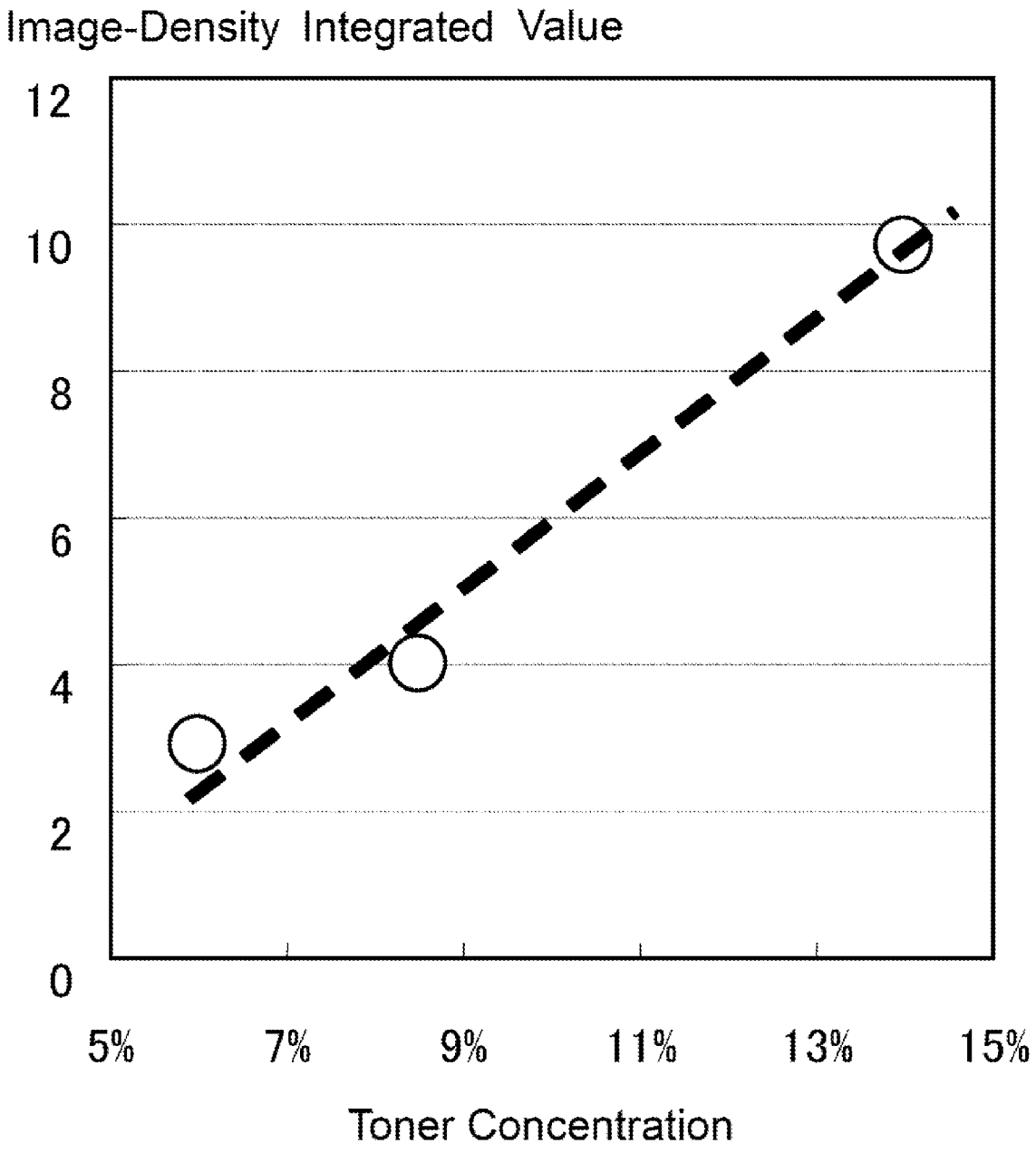
FIG. 4 illustrates a relationship between an image-density integrated value and toner concentration in the one embodiment.

FIG. 4 is a graph illustrating a relationship between an image-density integrated value and toner concentration. The image-density integrated value is a value that the image density illustrated in FIG. 3 is integrated from the head to the end of the developed toner image. The image-density integrated value reflects the toner amount in the development nip N2. As illustrated in the graph, there is a correlation relationship between the image-density integrated value and the toner concentration. Consequently, in a state where the developing roller 17 is stopped, the control unit 100 integrates the image density, which is detected by the image density sensor 19, of the toner image developed by a drive of the photoreceptor drum 2 alone. Then, the control unit 100 calculates the toner concentration in the two-component developer based on the integrated value. For example, the control unit 100 calculates the toner concentration by referring to a table that stores a correspondence relationship between the image-density integrated value and the toner concentration in a table form in a memory.

To enhance correlativity between the image-density integrated value and the toner concentration, it is preferred that the control unit 100 discharge almost all the toner (preferably, 90% or more) contained in the developer in the development nip N2 to the photoreceptor drum 2.

In the property of detecting the reflected light, the image density sensor 19 has a property where its detection accuracy is degraded when the image density is high. Consequently, the control unit 100 may disregard the detection results by the image density sensor 19 for the head portion of the toner image with high image density, and integrate the image density in the middle of the toner image. This ensures calculating the toner concentration with higher accuracy.

A variation of the amount of the developer in the development nip N2 causes a variation of the image-density integrated value as well. Namely, in the graph in FIG. 4, the overall plots shift upward for the large amount of the developer while the overall plots shift downward for the small amount of the developer. Consequently, to calculate the toner concentration under the constantly identical condition, it is preferred to detect a nip width of the development nip N2 and correct the calculated toner concentration corresponding to this nip width. It is assumed that the amount of the developer in the development nip N2 increases and decreases corresponding to the nip width. Thus, in a state where both the developing roller 17 and the photoreceptor drum 2 are stopped, the control unit 100 applies the developing bias to the photoreceptor drum 2 to develop it using the developer in the development nip N2. Subsequently, the control unit 100 moves the toner in this developer onto the surface of the photoreceptor drum 2, so as to form, for example, a strip-shaped patch image on this surface.

Figure 5:
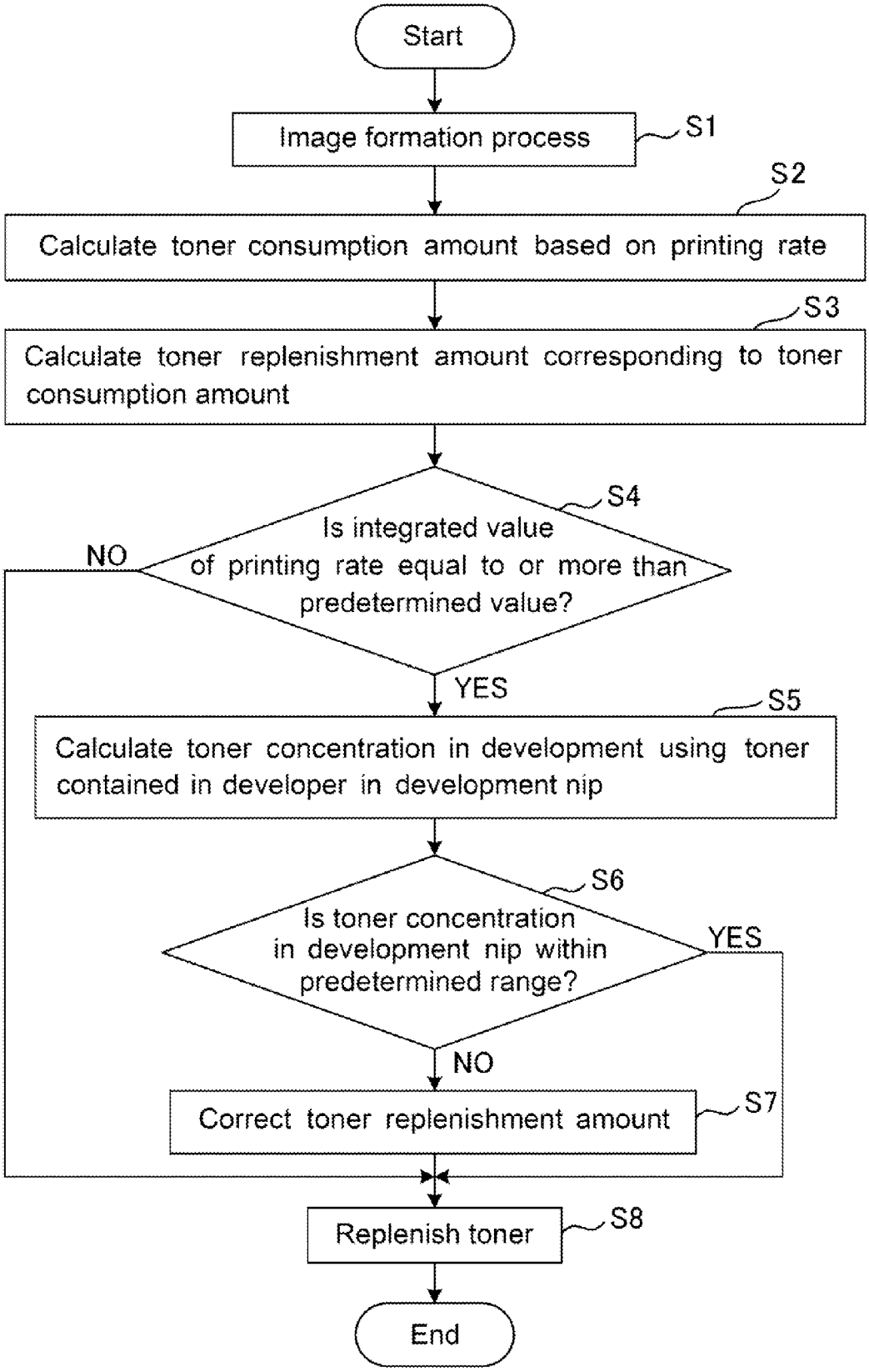
FIG. 5 illustrates a toner replenishment process of the image forming apparatus according to the one embodiment.

Next, the following describes a toner replenishment process of the image forming apparatus 1. FIG. 5 illustrates the toner replenishment process of the image forming apparatus 1.

The image forming apparatus 1 forms an image to be printed based on image information output from external equipment such as a PC (Step 51). The control unit 100 calculates the toner consumption amount based on the printing rate of these images (for example, integrates the printing rates) (Step S2). Furthermore, the control unit 100 calculates the toner amount to be replenished corresponding to the calculated toner consumption amount (Step S3).

When the toner consumption amount (the integrated value of the printing rate) calculated at Step S2 is not equal to or more than a predetermined value (No in Step S4), the control unit 100 instructs the toner cartridge 5 to perform toner replenishment, and causes the toner cartridge 5 to replenish the toner just the toner replenishment amount calculated at Step S3 (Step S8).

Figure 6:
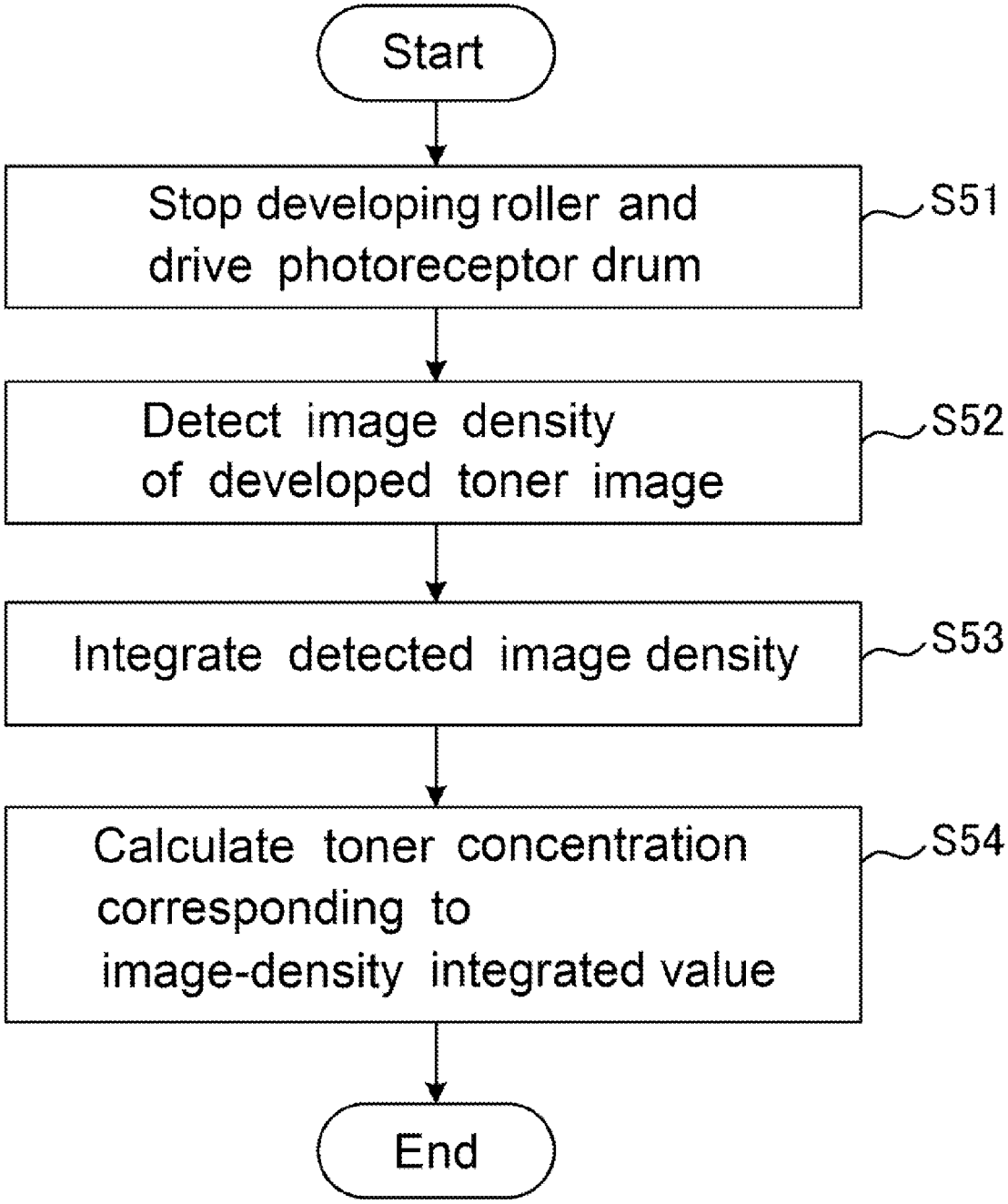
FIG. 6 illustrates a detail of the toner concentration calculation process according to the one embodiment.

On the other hand, when the integrated value of the printing rate calculated at Step S2 is equal to or more than the predetermined value (Yes in Step S4), the control unit 100 calculates the toner concentration of this image in a case where a predetermined image by the toner contained in the developer in the development nip N2 is developed (Step S5). FIG. 6 illustrates a detail of Step S5 (toner concentration calculation process) in FIG. 5.

The control unit 100 drives the photoreceptor drum 2 alone in a state where the developing roller 17 is stopped, so as to discharge the toner contained in the developer in the development nip N2 to the photoreceptor drum 2 (Step S51). Thus, the development using the toner contained in the developer in the development nip N2 forms the toner image on the surface of the photoreceptor drum 2, which is extended in the rotation direction of the photoreceptor drum 2. The image density sensor 19 detects the image density of the toner image developed at Step S51 (Step S52). The control unit 100 integrates the image density detected at Step S52 (Step S53). Then, the control unit 100 refers to a correspondence table of the image-density integrated value stored preliminarily in a memory and the toner concentration (Step S54) to calculate the toner concentration corresponding to the image-density integrated value calculated at Step S53.

Back to FIG. 5, the control unit 100 determines whether or not the toner concentration calculated at Step S5 is within a predetermined range (Step S6). When this toner concentration is within the predetermined range (Yes in Step S6), the control unit 100 instructs the toner cartridge 5 to toner replenishment, and causes the toner cartridge 5 to replenish the toner just the toner replenishment amount calculated at Step S3 (Step S8).

On the other hand, when the toner concentration is out of the predetermined above range (No in Step S6), the control unit 100 corrects the toner replenishment amount calculated at Step S3 (Step S7). Specifically, when the toner concentration is lower than the predetermined above range, the control unit 100 performs correction of increase of the toner replenishment amount. When the toner concentration is higher than the predetermined above range, the control unit 100 performs correction of decrease of the toner replenishment amount. After the correction of the toner replenishment amount, the control unit 100 instructs the toner cartridge 5 to perform toner replenishment. Thus, the control unit 100 causes the toner cartridge 5 to replenish the toner just the toner replenishment amount corrected at Step S7 (Step S8).

As described above, with the embodiment, it is unnecessary to use a toner concentration sensor such as a magnetic permeability sensor, which can detect the toner concentration (T/C) in the developing device 16. This ensures an achievement of the low-cost image forming apparatus 1. The image forming apparatus 1 can calculate the toner concentration in the developer without being affected by environment such as humidity. Thus, the image forming apparatus 1 controls the toner concentration in the two-component developer within the constant range. This ensures less generation of replenish fog and image failure of carrier development, for example.

The disclosure has been described above with the embodiment. The disclosure is not limited to the configuration of the above-described embodiments and can be variously modified. For example, an intermediate transfer belt method image forming apparatus may cause the image density sensor 19 to detect the print density of the transferred toner image on an intermediate transfer belt. While in the above-described embodiments, the description is made with the use of the printer as one embodiment of the image forming apparatus according to the disclosure, this is one example, and other electronic devices, for example, other types of image forming apparatus such as a copying machine, a facsimile device, and a multi-functional peripheral may be applicable.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. An image forming apparatus, comprising:

an image carrier having a surface on which an electrostatic latent image is formed;

a developing roller arranged to face the image carrier to form a development nip between the image carrier and the developing roller, the developing roller supplying toner in a two-component developer carried on a surface of the developing roller to the image carrier in the development nip so as to develop the electrostatic latent image; and a control unit that drivingly controls the image carrier and the developing roller; wherein the control unit discharges the toner in the development nip to the image carrier in a state where the developing roller is stopped, so as to calculate a toner concentration in the two-component developer based on an amount of discharged toner.

2. The image forming apparatus according to claim 1, further comprising an image density sensor that detects a print density of a toner image on a surface of the image carrier, the toner image being developed by the developing roller, wherein the control unit drives the image carrier in a state where the developing roller is stopped so as to develop a toner image, integrates the image density detected by the image density sensor for the toner image, and calculates a toner concentration in the two-component developer based on the integrated value.

3. The image forming apparatus according to claim 2, wherein the control unit does not add the image density of a leading portion as a forming starting portion of the toner image for the toner image, and adds the image density of the toner image in another portion to integrate the image density of the toner image for the toner image.

4. The image forming apparatus according to claim 1, wherein the control unit applies a developing bias to the image carrier in a state where both the developing roller and the image carrier are stopped, develops with toner contained in the two-component developer in the development nip to form a strip-shaped patch image on the surface of the image carrier, and corrects the toner concentration calculated corresponding to a band width of the formed patch image.

5. The image forming apparatus according to claim 1, wherein the control unit discharges 90% or more of the toner contained in the two-component developer in the development nip to the image carrier in a state where the developing roller is stopped.

* * * * *